US011566494B2

(12) United States Patent
Greci et al.

(10) Patent No.: US 11,566,494 B2
(45) Date of Patent: Jan. 31, 2023

(54) RETRIEVABLE WELL ASSEMBLIES AND DEVICES

(71) Applicant: Halliburton Energy Services, Inc., Houston, TX (US)

(72) Inventors: Stephen Michael Greci, Little Elm, TX (US); Michael Linley Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 677 days.

(21) Appl. No.: 16/306,721

(22) PCT Filed: Jan. 26, 2018

(86) PCT No.: PCT/US2018/015521
§ 371 (c)(1),
(2) Date: Dec. 3, 2018

(87) PCT Pub. No.: WO2019/147268
PCT Pub. Date: Aug. 1, 2019

(65) Prior Publication Data
US 2021/0222522 A1 Jul. 22, 2021

(51) Int. Cl.
*E21B 41/00* (2006.01)
*E21B 1/02* (2006.01)
(Continued)

(52) U.S. Cl.
CPC ..... *E21B 41/0085* (2013.01); *E21B 17/0283* (2020.05); *E21B 23/03* (2013.01); *E21B 34/066* (2013.01); *E21B 47/01* (2013.01)

(58) Field of Classification Search
CPC ..... E21B 47/01; E21B 41/0085; E21B 17/0283; E21B 23/03; E21B 34/066
See application file for complete search history.

(56) References Cited

U.S. PATENT DOCUMENTS 4,294,313 A * 10/1981 Schwegman ..... E21B 23/03 166/117.5
5,412,568 A 5/1995 Schultz et al.
(Continued)

FOREIGN PATENT DOCUMENTS

EP 2642066 9/2013
GB 2407335 4/2005
(Continued)

OTHER PUBLICATIONS

International Patent Application No. PCT/US2018/015521, International Search Report and Written Opinion, dated Oct. 19, 2018, 13 pages.
(Continued)

*Primary Examiner* — D. Andrews
(74) *Attorney, Agent, or Firm* — Kilpatrick Townsend & Stockton LLP

(57) ABSTRACT

A wellbore assembly can include a completion string having a side pocket. A downhole device can be positioned within the side pocket of the completion string. The downhole device can have a first end sized and shaped for coupling to a tool for inserting and removing the downhole device in the side pocket while the completion string is positioned downhole in a wellbore. The downhole device can be an electronic device.

17 Claims, 7 Drawing Sheets

(51) Int. Cl.

| | |
|---|---|
| ***E21B 34/06*** | (2006.01) |
| ***E21B 17/02*** | (2006.01) |
| ***E21B 23/03*** | (2006.01) |
| ***E21B 47/01*** | (2012.01) |

(56) References Cited

U.S. PATENT DOCUMENTS

| | | | | |
|---|---|---|---|---|
| 5,458,200 | A | 10/1995 | Lagerlef et al. | |
| 5,535,828 | A * | 7/1996 | der Kinderen | E21B 43/123 166/372 |
| 5,839,508 | A * | 11/1998 | Tubel | G01V 1/42 166/65.1 |
| 6,070,608 | A * | 6/2000 | Pringle | E21B 34/066 137/155 |
| 6,182,764 | B1 | 2/2001 | Vaynshteyn | |
| 6,230,812 | B1 | 5/2001 | Reaux et al. | |
| 6,343,651 | B1 * | 2/2002 | Bixenman | E21B 33/124 166/278 |
| 7,158,446 | B2 | 1/2007 | Gardner et al. | |
| 7,171,309 | B2 | 1/2007 | Goodman et al. | |
| 7,676,680 | B2 | 3/2010 | Seelos et al. | |
| 7,989,113 | B2 | 8/2011 | Fujita et al. | |
| 8,033,328 | B2 | 10/2011 | Hall et al. | |
| 8,169,854 | B2 | 5/2012 | Godager et al. | |
| 8,196,678 | B2 | 6/2012 | Jeffryes | |
| 8,319,657 | B2 | 11/2012 | Godager et al. | |
| 8,528,395 | B2 | 9/2013 | Griffiths et al. | |
| 8,678,035 | B2 | 3/2014 | Fripp et al. | |
| 8,701,771 | B2 | 4/2014 | Dykstra et al. | |
| 8,752,629 | B2 | 6/2014 | Moen | |
| 8,893,809 | B2 | 11/2014 | Charles et al. | |
| 8,994,550 | B2 | 3/2015 | Millot et al. | |
| 2002/0020533 | A1 | 2/2002 | Tubel et al. | |
| 2002/0029883 | A1 | 3/2002 | Vinegar et al. | |
| 2003/0164240 | A1 | 9/2003 | Vinegar et al. | |
| 2008/0130412 | A1 | 6/2008 | Fink et al. | |
| 2009/0008078 | A1 | 1/2009 | Patel | |
| 2009/0164240 | A1 | 6/2009 | Friedmann et al. | |
| 2011/0180267 | A1 | 7/2011 | Wildman et al. | |
| 2011/0192596 | A1 * | 8/2011 | Patel | E21B 47/13 166/250.11 |
| 2012/0067567 | A1 | 3/2012 | Rytlewski et al. | |
| 2014/0069639 | A1 | 3/2014 | Mackenzie et al. | |
| 2016/0108692 | A1 | 4/2016 | Scott | |
| 2017/0335679 | A1 | 11/2017 | Tubel et al. | |
| 2018/0010449 | A1 | 1/2018 | Roberson et al. | |
| 2018/0058202 | A1 | 3/2018 | Disko et al. | |
| 2018/0156030 | A1 * | 6/2018 | Arsalan | E21B 33/1277 |
| 2019/0024477 | A1 | 1/2019 | Coulston | |

FOREIGN PATENT DOCUMENTS

| | | | |
|---|---|---|---|
| WO | 2016181154 | | 11/2016 |
| WO | 2018093378 | A1 | 11/2016 |
| WO | 2018093377 | A1 | 5/2018 |

OTHER PUBLICATIONS

Schlumberger , "WRFC-H Wireline-Retrievable Flow Control Valve for Gas Lift Applications", 2010, 2 pages.

* cited by examiner

RETRIEVABLE WELL ASSEMBLIES AND DEVICES

TECHNICAL FIELD

The present disclosure relates generally to assemblies and devices for use in a subterranean wellbore, and more particularly (although not necessarily exclusively), to assemblies and devices that may be retrievable from a completion string, for example but not limited to for repairing, replacing or upgrading a device on the completion string.

BACKGROUND

Once a well has been drilled, the well is completed. Completion of the well includes installing a completion string downhole within the well. The completion string may include various devices, including but not limited to electronic devices such as sensors and valves. The completion string, including the devices thereon, is intended to remain within the well for the life of the well. The downhole environment is an extreme environment where high temperatures, high pressure, and other characteristics can damage devices included on the completion string. To remove the completion string or a portion thereof to replace, repair, upgrade or otherwise alter the devices included on the completion string is extremely costly and undesirable.

DETAILED DESCRIPTION

Figure 1:
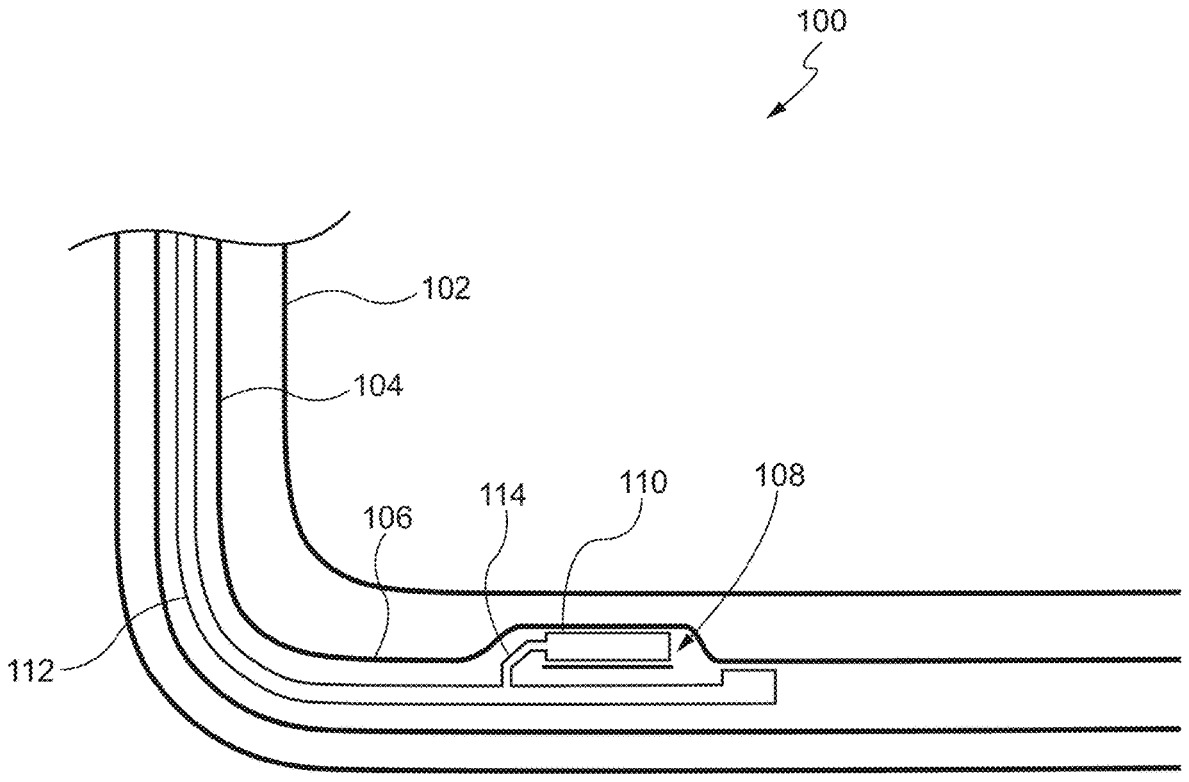
FIG. 1 is a schematic illustration of a tool positioned downhole and coupled to a device within a completion string, according to an aspect of the present disclosure.

Certain aspects and features of the present disclosure relate to devices positioned within a side pocket of a completion string. The devices may be positioned within the side pocket or removed from the side pocket using a tool while the completion string is downhole. The device may be an electronic device that may be self-powered or powered by a downhole power generator, as opposed to an electrical line running to a surface of a wellbore. In some aspects, the downhole power generator may be positioned in another side pocket of the completion string.

Devices, including but not limited to electronic devices, can be positioned downhole on a completion string. The devices on the completion string are exposed to an extreme environment, including extreme heat and pressure. Electronic devices positioned on a completion string downhole can be unreliable as the electronics can often be harmed (e.g., broken, degraded, damaged, etc.) by the extreme environment. Even where an electronic device survives the extreme environment downhole, the technology of the electronic device can quickly become outdated as the years go on and technology advances. For example, an electronic device positioned on a completion string and installed downhole can quickly become outdated as the life of the well continues for some five, ten, fifteen, twenty, or even thirty-plus years.

While some devices can be positioned downhole within an inner diameter of a completion string using wireline or coiled tubing, such devices are not independently coupled to or secured within the completion string and thus the wireline or coiled tubing remains in its position downhole. Wireline and coiled tubing can block access to additional devices positioned below those tubing strings, requiring the removal of multiple devices and wirelines/coiled tubings to get access to a device positioned further downhole. Thus, it is desirable to have retrievable devices, including electronic devices, positioned downhole on a completion string without the use of wirelines or coiled tubings.

According to aspects of the present disclosure, a device can be sized and shaped to be positioned within the side pocket of the completion string. One end of the device can be sized and shaped to couple to a tool, for example a kick-off tool, for positioning the device downhole and into the side pocket, the tool can also be used to remove the device from the side pocket and return it to the surface. The device can be any number of downhole devices, including but not limited to an electronics module, a valve assembly, and a downhole power generator. An electronics module can include but is not limited to an actuator, a telemetry device, or a sensor (e.g., for sensing temperature, pressure, flow rate, flow composition, etc.). In some aspects of the present disclosure, the device is an electronic device that is either self-powered or powered by a downhole power generator as opposed to an electrical line from the surface of the wellbore.

The device may be positioned within the side pocket of the completion string after the completion of the well, for example after the completion string has been installed by a tool. The device may also be retrieved from the side pocket of the completion string by the tool and returned to the surface for repair, replacement, or upgrading. In some aspects, the device may be retrieved to have its hardware or software upgraded following technological advancements that have been made since the device was initially positioned within the completion string. The device may be returned to the side pocket of the completion string (while the completion string remains downhole) by the tool after repair/replacement/upgrading of the device.

The device need not be manufactured to survive the entire lifetime of a well given it may be retrieved and returned to the surface to be replaced, repaired, or upgraded. Thus, the cost of manufacture of the device may be reduced. The efficiency of the well may also improve by permitting retrieval of the device from the side pocket in the completion string for repair or replacement, by allowing broken or poorly functioning devices to be repaired or replaced without removal of the completion string itself. Similarly, the efficiency of the well may be improved by retrieving a device for upgrading following technological advancements.

These illustrative aspects and examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 depicts by schematic illustration an example of a well system 100 that includes a bore that is a wellbore 102 extending through various earth strata. A completion string 104 may extend downhole within the wellbore 102. The completion string 104 may remain in the wellbore 102 for the life of the well. The completion string 104 may include a mandrel 106. The mandrel 106 may include a side pocket 108 and may be referred to as a side pocket mandrel. The mandrel 106 may include more side pockets 108 than are shown in FIG. 1.

A tool 112 may be positioned within an inner diameter of the completion string 104. In some aspects, the tool 112 may be a kickoff tool, though other suitable tools may be utilized. The tool 112 has an arm 114 that may couple to a device 110. The tool 112 may couple to the device 110 and carry the device 110 downhole. The tool 112 may position the device 110 within the side pocket 108 of the mandrel 106 and decouple from the device 110 while the device 110 is downhole in the side pocket 108. Thus, the device 110 may be positioned within the side pocket 108 by the tool 112 at some time after the completion string 104 has been positioned downhole. The device 110 may be an electronics module, a valve assembly, a downhole power generator, or other devices for use downhole in a wellbore 102. In some aspects, the device 110 contains electronics that require electrical energy.

In another aspect, the tool 112 may couple to and retrieve the device 110 from within the side pocket 108 of the mandrel 106 and return it to the surface. The device 110 may be returned to the surface to repair the device 110, replace the device 110 with a new device, upgrade software or hardware on the device 110, or other actions. The tool 112 can then return the repaired/upgraded device or a new device downhole into the side pocket 108. The ability to repair, replace, or upgrade the device 110 after the completion string 104 has been installed, for example many years later, can improve the efficiency of the well system. For example by repairing or replacing the device 110 without having to remove the completion string 104 that is very costly and sometimes impossible. The device 110 may also be replaced, or its software upgraded, to permit use of new technology that was not available at the time the completion string 104 or the device 110 was originally installed downhole.

In some aspects, the device 110 may be an electronics module, for example but not limited to a sensor (e.g., pressure sensor, flow rate sensor, or flow composition sensor), an actuator, wireless transceiver for wireless telemetry, or other electronics modules for use downhole. In some aspects, the device 110 may be a valve assembly for controlling flow from an outer diameter of the completion string 104 to the inner diameter of the completion string 104. In some aspects, the valve assembly may be an electronic valve assembly. In still yet other aspects, the device 110 may be a downhole power generator that converts flow energy to electrical energy. The downhole power generator can provide power to other downhole devices, for example but not limited to additional devices positioned within additional side pockets of the completion string. In still yet other aspects, the wireless transceiver may be an acoustic transmitter and an acoustic receiver for transmitting vibrations in either the tubing or in the fluid.

Figure 2A:
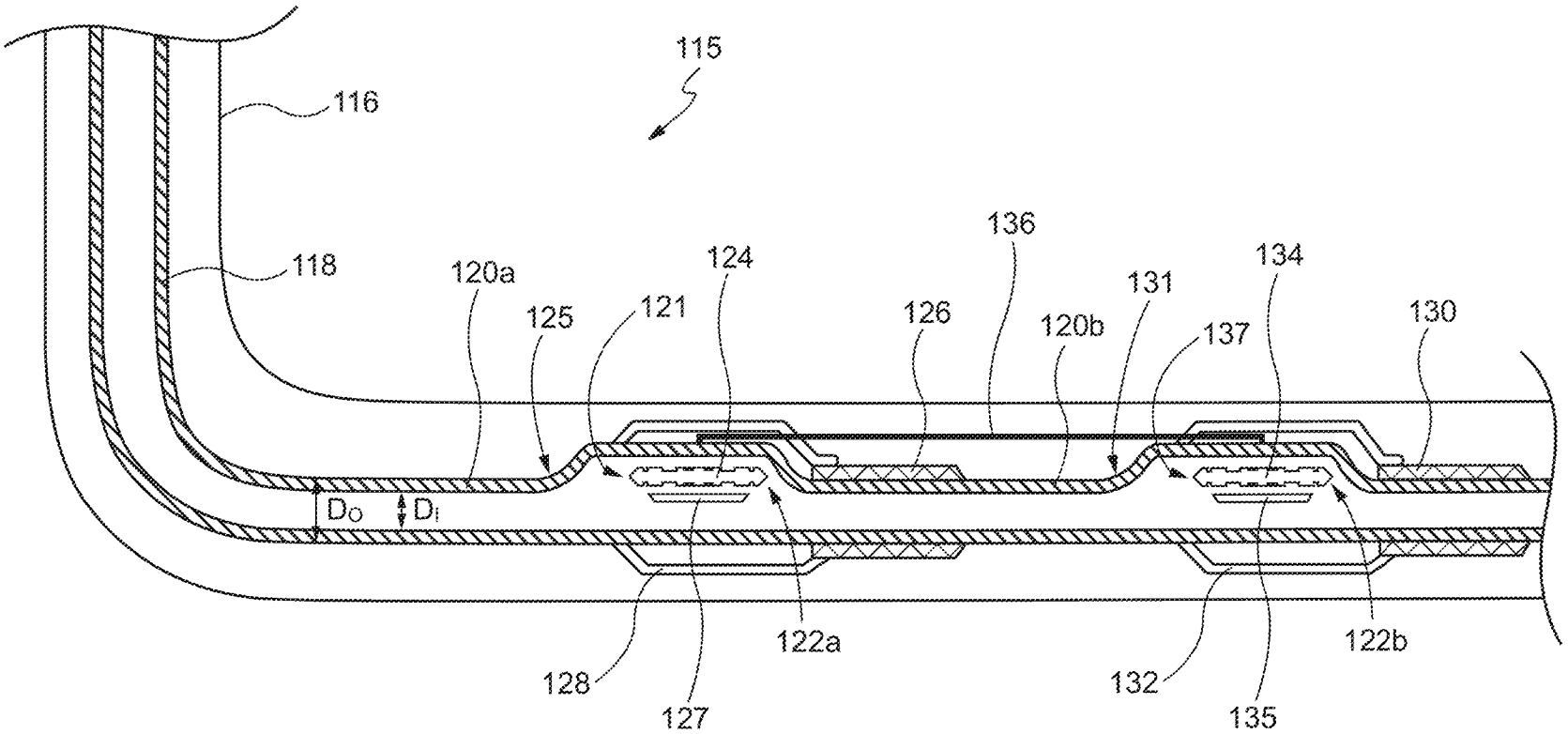
FIG. 2A is a cross-sectional side view of a completion string positioned within a wellbore, according to an aspect of the present disclosure.

FIG. 2A depicts a cross-sectional view of a portion of a well system 115 having a wellbore 116 through a subterranean formation within which a completion string 118 is positioned. The completion string 118 includes multiple mandrels 120*a*, 120*b*. Though FIG. 2A depicts two mandrels 120*a*, 120*b*, in some aspects more or fewer mandrels may be used. The mandrels 120*a*, 120*b* include side pockets 122*a*, 122*b* respectively. Also, while each of the mandrels 120*a*, 120*b* are each shown as having one side pocket 122*a*, 122*b* more or fewer side pockets may be included in each mandrel. For example, in some aspects a mandrel, such as mandrel 120*a* may include two side pockets that may each hold a respective device. As shown in FIG. 2A, a device, for example a generator 124 may be positioned in the side pocket 122*a* of the mandrel 120*a*. Although the device is shown in FIG. 2A as the generator 124, in some aspects the device may instead be an electronics module (e.g., a sensor, an actuator, etc.), a valve assembly, or another downhole tool. The generator 124 has a body portion having a first end 121 that is sized and shaped to couple to a tool, for example the tool 112 shown in FIG. 1. The generator 124 may be secured in the side pocket 122*a* or removed from the side pocket 122*a* by the tool while the completion string 118 is downhole. The generator 124 remains in position within the side pocket 122*a* by an outer wall 125 of the mandrel 120*a* and a sidewall 127 of the side pocket 122*a*.

A screen assembly 126 may be positioned at least partially around the mandrel 120*a*. The screen assembly 126 may be a sand screen or other suitable screen assembly for filtering fluid from an annulus of the wellbore 116. A shroud 128 may be positioned at least partially around the mandrel 120*a* and may direct fluid flow from the outer diameter Do of the completion string 118 to the inner diameter Di of the completion string 118. A screen assembly 130 may be positioned around the mandrel 120*b*. The screen assembly 130 may be a sand screen or other suitable screen assembly for filtering fluid from an annulus of the wellbore 116. A shroud 132 may be positioned around the mandrel 120*b* and may direct fluid flow from the outer diameter Do of the completion string 118 to the inner diameter Di of the completion string 118.

A device, for example as shown in FIG. 2A a sensor 134, may be positioned in the side pocket 122*b* of the mandrel 120*b*. In other aspects, the device in the side pocket 122*b* may be a valve assembly, an actuator, a downhole power generator, or another downhole tool. The sensor 134 may be a temperature sensor, a pressure sensor, a flow rate sensor, or another sensor for use downhole. The sensor 134 may have a body portion that includes a first end 137 that is sized and shaped to couple to a tool, for example the tool 112 shown in FIG. 1. The sensor 134 may be inserted into the side pocket 122*b* or removed from the side pocket 122*b* by the tool. The sensor 134 may be secured within the side pocket 122*b* by a wall 131 of the mandrel 120*b* and a side wall 135 of the side pocket 122*b*.

The sensor 134 may be powered by the generator 124 positioned in the side pocket 122*a*. The power generated by the generator 124 may be transmitted to the sensor 134 via an electric line 136. Thus, the sensor 134 may be powered without an electric line running to a surface of the wellbore. In other aspects, the sensor 134 may be include a power source, for example but not limited to a generator, for powering itself.

Figure 2B:
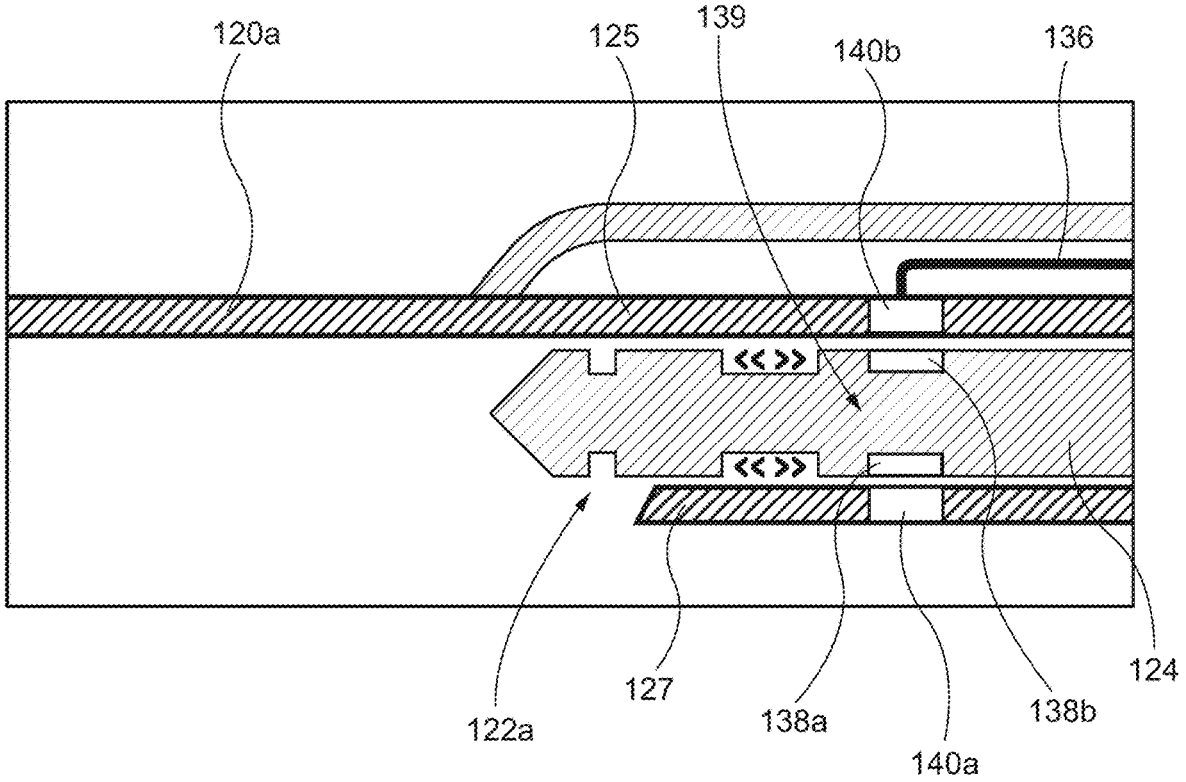
FIG. 2B is an enlarged portion of a device positioned within a side pocket of the completion string of FIG. 2A, according to an aspect of the present disclosure.

FIG. 2B is an enlarged portion of AG. 2A showing the generator 124 positioned within the side pocket 122*a* of the mandrel 120*a*. The generator 124 can include a power coupling connection 139 between the generator 124 and the completion string 118. The power coupling connection 139 can include a set of power couplers 138*a*, 138*b* on the generator 124 and an additional set of power couplers 140*a*, 140*b* positioned on the mandrel 120*a*. The power couplers 138*a*, 138*b* and 140*a*, 140 may be capacitive couplers, inductive couplers, or may be direct connections. One power coupler 140*a* can be positioned on the sidewall 127. The other power coupler 140*b* can be positioned on the outer wall 125 of the mandrel 120*a*. The power couplers 138*a*, 138*b*, 140*a*, 140*b* can create the power coupling connection 139, for example via capacitive coupling, inductive coupling, or via direct connections. The energy generated by the generator 124 can be transmitted to the electric line 136 by the power coupling connection 139. The electric line 136 can transmit the electrical energy generated by the generator 124 to other downhole tools, for example but not limited to tools positioned within other side pockets of the completion string 118. For example, as shown in FIG. 2A the electrical energy generated by the generator 124 is transmitted to the sensor 134 via the electrical line 136. The electrical line 136 could also be coupled to additional downhole tools for powering said tools using the electrical energy generated by the generator 124.

The generator 124 and the sensor 134 can each be inserted into or removed from the respective side pockets 122*a*, 122*b* by a tool while downhole, for example as shown in FIG. 1. Thus, the generator 124 and sensor 134 can be replaced, upgraded (e.g., software or hardware upgrades), or repaired without removal of the completion string 118 from the wellbore 116. As described above, each of the generator 124 and the sensor 134 can, in some aspects, be replaced with another electronics module (a, different sensor, an actuator, etc.) or a valve assembly.

Figure 3:
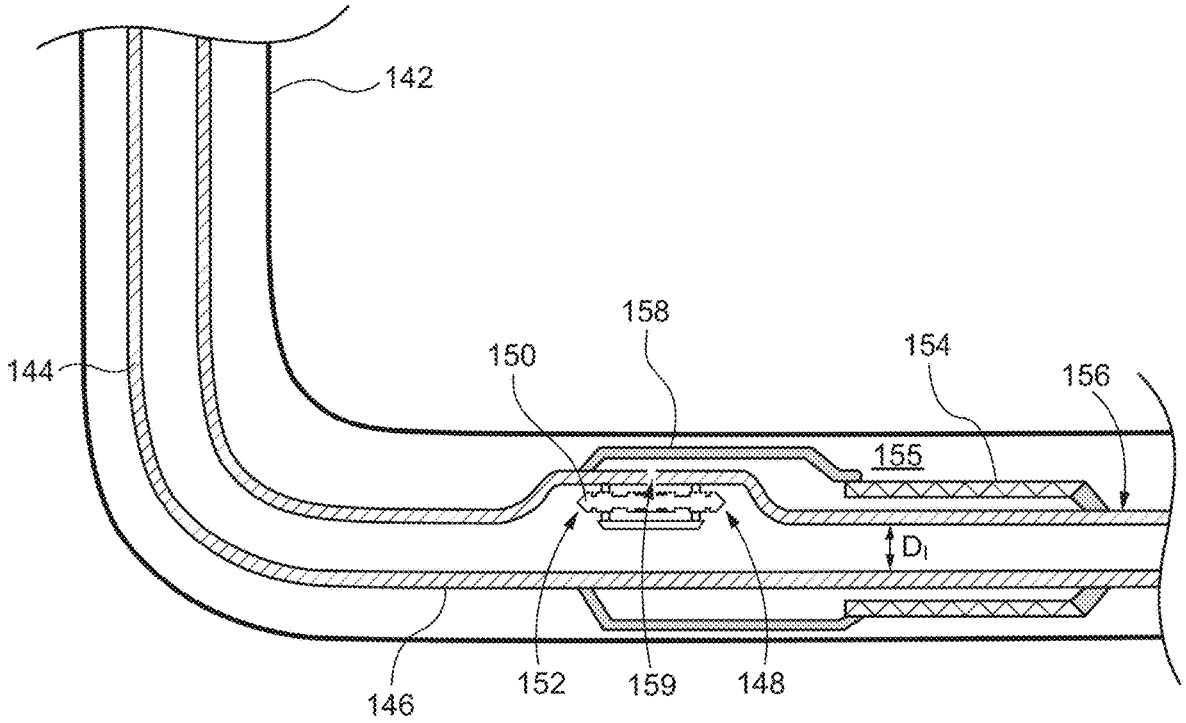
FIG. 3 is a cross-sectional side view of a completion string positioned within a wellbore, according to an aspect of the present disclosure.

FIG. 3 depicts cross-sectional view of a well system 141 including a wellbore 142 within which a completion string 144 is positioned. The completion string 144 includes a mandrel 146 that has a side pocket 148. A device, for example a valve assembly 150 as shown in FIG. 3, may be positioned within the side pocket 148 of the mandrel 146. The valve assembly 150 includes a first end 152 that is sized and shaped to couple to a tool, for example tool 112 shown in FIG. 1, for insertion and removal of the valve assembly 150 from the side pocket 148. In some aspects, the valve assembly 150 is coupled to a generator positioned downhole, for example within another side pocket of the completion string 144 as shown in the aspect of the present disclosure depicted in FIGS. 2A and 2B. In some aspects, the valve assembly 150 may generate its own electrical energy, for example as shown in the aspect of the present disclosure depicted in FIG. 4. In some aspects, a screen assembly 154 is positioned at least partially around the mandrel 146 for filtering materials from a fluid flowing through an annulus 155 between the wellbore 142 and an outer surface 156 of the mandrel 146. A shroud 158 may be positioned at least partially around the mandrel 146 to direct flow from the screen assembly 154 to the valve assembly 150. While FIG. 3 depicts the screen assembly 154 and shroud 158 passing entirely around the mandrel 146, in some aspects the screen assembly 154 and shroud 158 may pass only partially around the mandrel 146, for example as shown in FIGS. 5A-5B. In such aspects, the outer diameter of the mandrel 146, including the shroud 158 and screen assembly 154, can be reduced.

The valve assembly 150 can control an amount of fluid flowing between the annulus 155 and an inner diameter Di of the mandrel 146. Fluid can flow through an opening 159 in the outer surface 156 of the mandrel 146 and enter the valve assembly 150. The valve assembly 150 can control the amount of fluid that passes through the valve assembly 150 and enters the inner diameter Di of the completion string 144 (i.e. the mandrel 146) for flowing to the surface of the wellbore 142.

In some aspects, the valve assembly 150 can be an inflow control device ("ICD") valve assembly, for example an electric inflow control device (eICD) sold by Halliburton. In some aspects, the valve assembly 150 may be a ball valve assembly. In other aspects, the valve assembly 150 may include a piston or other actuator. The valve assembly 150 can be more easily replaced, repaired, or upgraded because it is a separate device from the completion string 144 and it may be removed and reinserted within the completion string 144 while the completion string 144 is positioned downhole in the wellbore 142.

Figure 4:
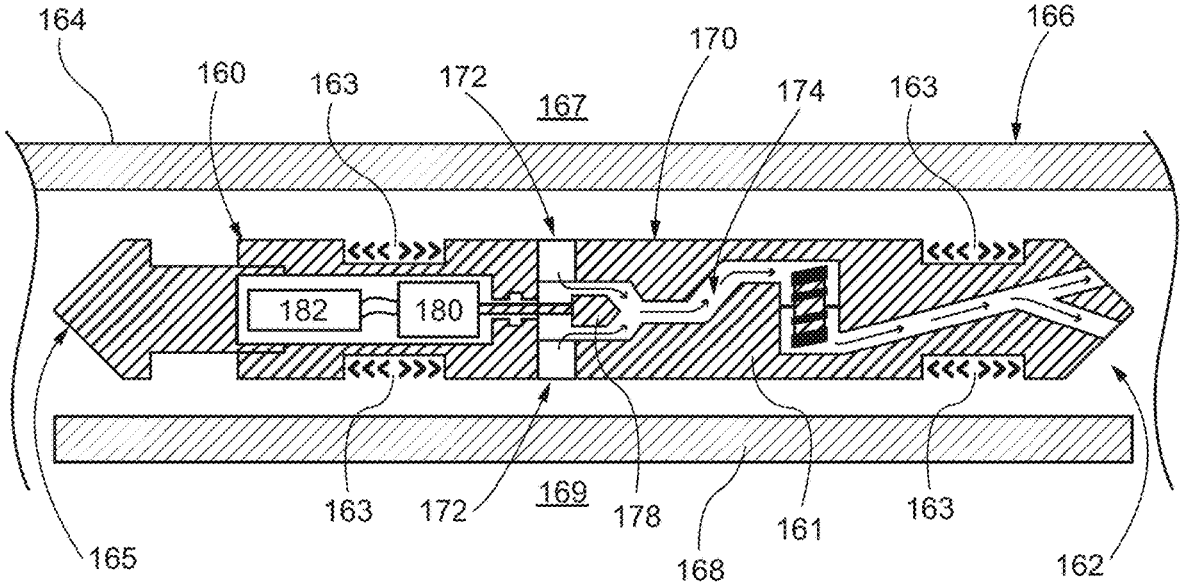
FIG. 4 is a cross-sectional side view of a valve assembly positioned within a side pocket of a completion string, according to an aspect of the present disclosure.
Figure 5A:
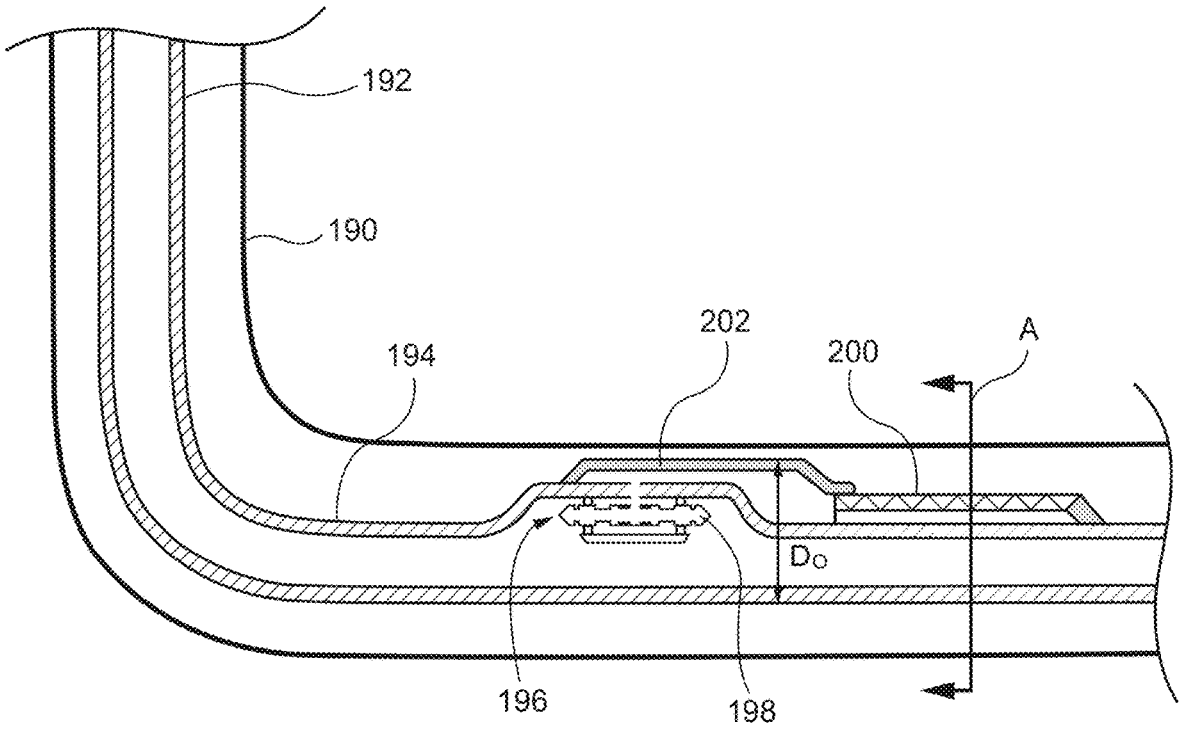
FIG. 5A is a cross-sectional side view of a completion string having a screen assembly, according to an aspect of the present disclosure.
Figure 5B:
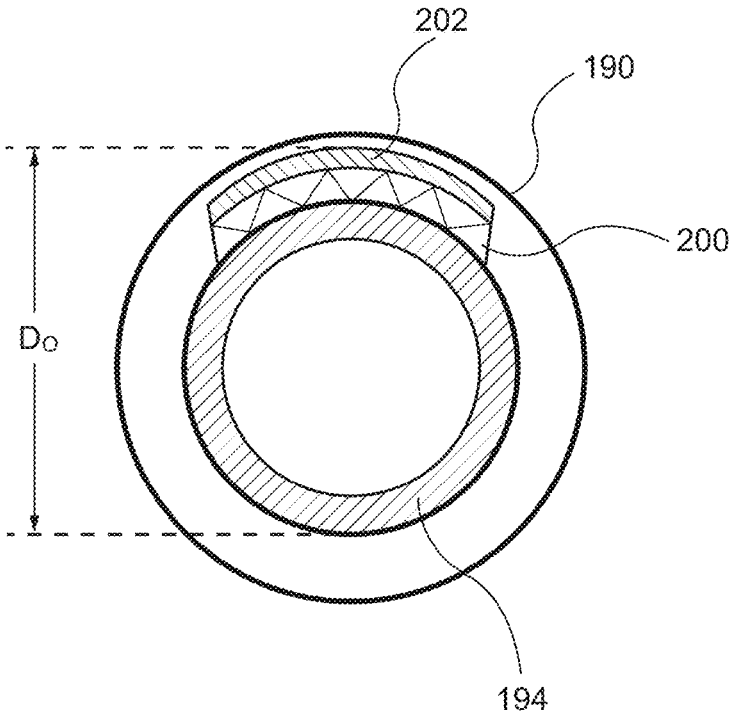
FIG. 5B is a cross-sectional front view of the completion string of FIG. 5A.

FIG. 4 depicts a valve assembly 160 according to an aspect of the present disclosure. The valve assembly 150 shown in FIG. 3 could, for example, be the valve assembly 160 shown in FIG. 4. The valve assembly 160 is positioned within a side pocket 162 of a completion string 164. The completion string 164 has an outer wall 166 and an inner wall 168 which define the side pocket 162. The valve assembly 160 includes a body 161 and seals 163. The seals 163 may form a seal between the body 161 of the valve assembly 160 and the outer wall 166 and the valve assembly 160 and between the inner wall 168 and the valve assembly 160. The valve assembly 160 also includes a first end 165 that is sized and shaped to couple to a tool for insertion or removal of the valve assembly 160 in the side pocket 162. As shown in FIG. 4, the first end 165 may be a triangular shape, or contain a fishing neck, though in some aspects the first end 165 may have any suitable shape for coupling to the tool. The valve assembly 160 can control a flow rate of fluid from an annulus 167 between the completion string 164 and a wellbore (not shown) and an inner region 169 of the completion string 164. The fluid that enters the inner region 169 of the completion string 164 can flow to a surface of the wellbore. In some aspects, the valve assembly 160 may receive a wireless command from the surface. In response to the wireless command from the surface the tool may adjust the amount of restriction of flow between the annulus 167 and the inner region 169 of the completion string 164.

The valve assembly 160 has an outer surface 170. Fluid may enter the valve assembly 160 through a pair of openings that define two entrances 172 to a fluid pathway 174. Another opening in the outer surface 170 defines an exit 176 from the fluid pathway 174. In some aspects, the valve assembly 160 may have more or fewer entrances to the fluid pathway 174. Also, in some aspects, the valve assembly 160 may include more or fewer exits from the fluid pathway 174. A plug 178 may be positioned within the fluid pathway 174. The plug 178 may be positioned to permit fluid flow to pass through the fluid pathway 174. The plug 178 may also be positioned to block the fluid pathway 174, thereby preventing fluid from flowing through the fluid pathway 174.

The position of the plug 178 may be controlled by a motor 180. The motor 180 may also be communicatively coupled to an electronics module 182. The electronics module 182 may, in some aspects, be a sensor. The electronics module 182 may receive a signal from the surface that corresponds to an instruction for where to position the plug 178. The electronics module 182 can receive for example, a pressure signal, an acoustic signal, an electromagnetic signal, or any other suitable signal. The electronics module 182 may transmit a signal to the motor 180 in response to receiving the signal from the surface. The signal from the electronics module 182 to the motor 180 can control the position of the plug 178 that is coupled to the motor 180.

The valve assembly 160 may control the flow of fluid to the surface of the wellbore by controlling the flow of fluid through the fluid pathway 174 of the valve assembly 160 based on the position of the plug 178. The electronics module 182 and the motor 180 can be powered by a turbine generator 184 positioned within the fluid pathway 174 of the valve assembly 160. In some aspects, the electronics module 182 and motor 180 may be powered by a different generator, for example a generator positioned within another side pocket of a mandrel of the completion string 164, as shown in FIG. 2A. Thus, the valve assembly 160 does not utilize an electrical line running to the surface of the wellbore.

The valve assembly 160 can be positioned in the side pocket 162 by the tool, for example the tool 112 (shown in FIG. 1), while the completion string 164 is downhole. The valve assembly 160 can also be removed from the side pocket 162 by the tool while the completion string 164 is downhole. The valve assembly 160 may be positioned within the side pocket 162 at some time after the installation of the completion string 164. The valve assembly 160 may also be removed from the side pocket 162 and returned to the surface for replacement, repair or upgrading (e.g., upgrading hardware or software). The valve assembly 160 (or its replacement device) can be returned to the side pocket 162 after repair/upgrading/replacement by the tool. Because the valve assembly 160 may be replaced, repaired, upgraded, or even installed downhole many years after the completion of the well, the valve assembly 160 does not need to be capable of surviving the life of the well. This can reduce costs associated with manufacturing the valve assembly 160.

FIG. 5A depicts a cross-sectional side-view of a wellbore 190 within which a completion string 192 is installed. The completion string 192 includes a mandrel 194 that has a side pocket 196. A valve assembly 198 is positioned within the side pocket 196. In some aspects, the valve assembly 198 can instead be an electronics module (e.g., sensor, actuator, etc.), a power generator, or any other suitable downhole device. A screen assembly 200 can be positioned partially around the mandrel 194, as shown in FIG. 5A. An outer diameter (Do) of the completion string 192 can be minimized by positioning the screen assembly 200 around only part of the mandrel 194 as opposed to around the entire mandrel 194 (as shown in the aspect depicted in FIGS. 2A-3). The screen assembly can filter particulates from the fluid passing through the screen assembly 200. A shroud 202 can be positioned partially around the mandrel 194 for directing the fluid flow to the valve assembly 198. FIG. 5B depicts a front cross-sectional view along the line "A" shown in FIG. 5A, looking towards the valve assembly 198. As shown in FIG. 5B, the screen assembly 200 and shroud 202 only partially encircle the mandrel 194 thereby minimizing the outer diameter Do of the mandrel 194 of the completion string 192.

Example #1: A wellbore assembly can include a completion string including a side pocket. The wellbore assembly can also include a downhole device positioned within the side pocket of the completion string, the downhole device having a first end sized and shaped for coupling to a tool for inserting and removing the downhole device in the side pocket while the completion string is downhole in a wellbore. The downhole device may be an electronic device.

Example #2: The wellbore assembly of Example #2 further comprising the downhole device being a sensor.

Example #3: The wellbore assembly of any of Examples #1-3 further featuring the downhole device being powered by a downhole power generator.

Example #4: The wellbore assembly of any of Examples #1-3 further featuring the downhole device including a downhole power generator for powering itself.

Example #5: The wellbore assembly of Example #3 further featuring the downhole power generator being positioned within an additional side pocket of the completion string and coupled to the downhole device via an electric line.

Example #6: The wellbore assembly of any of Examples #1-5 further featuring the downhole device being securable in the side pocket by an outer wall of the completion string and an inner wall of the side pocket.

Example #7: The wellbore assembly of any of Examples #1-6 further featuring the downhole device being a downhole power generator.

Example #8: The wellbore assembly of Example #7 further featuring the downhole power generator including a first pair of power couplers that form a power coupling connection with a second pair of power couplers on the completion string. The first and second pair of power couplers may be capacitive couplers or inductive couplers.

Example #9: The wellbore assembly of Example #1 further feature the downhole device being an actuator.

Example #10: The wellbore assembly of Example #1 further featuring the downhole device being a valve assembly.

Example #11: The wellbore assembly of Example #10 further featuring the valve assembly including a generator for powering an electronics module and motor of the valve assembly.

Example #12: The wellbore assembly of any of Examples #10-11 further featuring a screen assembly positioned around at least a portion of the completion string along a length of the completion string, and where the valve assembly includes a pair of seals for defining a seal between the valve assembly and the completion string.

Example #13: A downhole device for a wellbore may include a body portion sized and shaped to fit within a side pocket of a completion string. The downhole device may also include a first end that is sized and shaped to couple to a downhole tool for removing from, and inserting the downhole device into, the side pocket of the completion string while the completion string is downhole. The downhole device may be an electronic device.

Example #14: The downhole device of Example #14 may further feature the downhole device being a sensor.

Example #15: The downhole device of any of Examples #13-14 may further feature the downhole device including a generator for powering itself.

Example #16: The downhole device of any of Examples #13-15 may further feature the downhole device being a valve assembly.

Example #17: The downhole device of Example #16 may further feature the valve assembly including a generator for powering the valve assembly.

Example #18: The downhole device of Example #13 may further feature the downhole device being a downhole power generator for powering an additional downhole device.

Example #19: The downhole device of Example #18 may further feature a first pair of power couplers for forming a power coupling connection to a second pair of power couplers positioned on the completion string. The first pair and the second pair of power couplers may be capacitive couplers or inductive couplers.

Example #20: The downhole device of Example #13 may further feature the downhole device being an actuator.

The foregoing description of certain aspects, including illustrated aspects, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A wellbore assembly comprising:

a completion string including a plurality of side pockets, the completion string being positionable in a production zone of a wellbore;

a plurality of electronic inflow control devices, each electronic inflow control device being positioned within a side pocket of the plurality of side pockets of the completion string, each side pocket of the plurality of side pockets being spaced at a distance from another side pocket, each electronic inflow control device in each side pocket being electronically coupled via a wire, each electronic inflow control device having a first end sized and shaped for coupling to a tool for inserting and removing the electronic inflow control device in the side pocket of the plurality of side pockets while the completion string is downhole in the production zone of the wellbore, wherein each electronic inflow control device is securable in each side pocket by an outer wall of the completion string and an inner wall of the side pocket; and a downhole power generator configured to transmit power to the plurality of electronic inflow control devices via the wire; and wherein each electronic inflow control device includes a receiver for receiving an electromagnetic signal for controlling an amount of restriction of flow between an annulus of the wellbore and an inner region of the completion string.

2. The wellbore assembly of claim 1, wherein each electronic inflow control device of the plurality of electronic inflow devices includes an electronics module and motor powered by the downhole power generator.

3. The wellbore assembly of claim 2, further comprising a screen assembly positioned around at least a portion of the completion string along a length of the completion string, and wherein at least one electronic inflow control device of the plurality of electronic inflow control devices includes a pair of seals for defining a seal between the at least one electronic inflow control device and the completion string.

4. The wellbore assembly of claim 3, further comprising a shroud positioned around at least a portion of the completion string along a length of the completion string, and wherein the shroud is configured to direct flow from the screen assembly to the electronic inflow control device.

5. The wellbore assembly of claim 1, wherein the tool is a kick-off tool, and wherein the tool comprises an arm that is couplable to the electronic inflow control device.

6. The wellbore assembly of claim 1, wherein the receiver comprises an acoustic transmitter and an acoustic receiver for transmitting vibrations within the completion string or within the flow.

7. The wellbore assembly of claim 1, wherein the first end comprises a fishing neck.

8. The wellbore assembly of claim 1, wherein the wire does not extend to the surface of the wellbore.

9. The wellbore assembly of claim 1, further comprising:

a power coupler configured to couple the downhole generator to the wire for transmitting power, wherein the power coupler is a capacitive coupler or an inductive coupler.

10. An electronic inflow control device for a wellbore comprising:

a body portion sized and shaped to fit within a side pocket of a completion string; and a first end that is sized and shaped to couple to a downhole tool for removing from, and inserting the electronic inflow control device into, the side pocket of the completion string while the completion string is downhole in a production zone of the wellbore;

a downhole power generator for powering the electronic inflow control device;

a wireless receiver for receiving a wireless command for controlling an amount of restriction of flow through the electronic inflow control device; and a wire for communicatively coupling the electronic inflow control device to another electronic inflow control device positionable within another side pocket of the completion string at a distance, the wire being configured to transmit power from the downhole power generator to the other electronic inflow control device, wherein the electronic inflow control device is securable in the side pocket by an outer wall of the completion string and an inner wall of the side pocket.

11. The electronic inflow control device of claim 10, wherein the electronic inflow control device includes an electronics module and motor powered by the downhole power generator.

12. The electronic inflow control device of claim 11, wherein the wireless receiver comprises an acoustic transmitter and an acoustic receiver for transmitting vibrations within the completion string or within the flow when the electronic inflow control device is positioned within the side pocket of the completion string.

13. The electronic inflow control device of claim 10, wherein the first end comprises a fishing neck.

14. A method for controlling flow from a production zone into an inner region of a completion string comprising:

positioning a plurality of electronic inflow control devices within a plurality of side pockets of a completion string, each side pocket of the plurality of side pockets being spaced at a distance from adjacent side pockets of the plurality of side pockets, each electronic inflow control device further comprising:

a body portion sized and shaped to fit within a side pocket of the plurality of side pockets of a completion string; and a first end that is sized and shaped to couple to a downhole tool for removing from, and inserting the electronic inflow control device into, the side pocket of the completion string while the completion string is downhole in a production zone of a wellbore;

a downhole power generator for powering itself;

a wire for communicatively coupling the electronic inflow control device with another electronic inflow control device of the plurality of electronic inflow control devices in another side pocket of the plurality of side pockets, the wire being configured to transmit power from the downhole power generator to the other electronic inflow control device; and a wireless receiver for receiving a wireless electromagnetic signal from another electronic inflow control device of the plurality of electronic inflow control devices for controlling an amount of restriction of flow through the electronic inflow control device, wherein each electronic inflow control device is securable in the respective side pocket by an outer wall of the completion string and an inner wall of the side pocket.

15. The method for controlling flow from a production zone into an inner region of a completion string of claim 14, further comprising:

transmitting the wireless electromagnetic signal to a first electronic inflow control device of the plurality of electronic inflow control devices; and adjusting the amount of restriction of flow between an annulus of the wellbore and the inner region of the completion string.

16. The method for controlling flow from a production zone into an inner region of a completion string of claim 14, further comprising:

coupling an arm of the tool to a first electronic inflow control device of the plurality of electronic inflow control devices;

removing, by the arm of the tool, the electronic inflow control device from a first side pocket of the plurality of side pockets; and inserting, by the arm of the tool, the electronic inflow control device into the side pocket, the electronic inflow device having been updated, repaired, or replaced before insertion.

17. The method for controlling flow from a production zone into an inner region of a completion string of claim 14, further comprising:

powering, by the downhole power generator, an electronics module and a motor included in at least one electronic inflow control device of the plurality of electronic inflow control devices.

* * * * *